United States Patent [19]

Kobayashi et al.

[11] Patent Number: 4,681,505

[45] Date of Patent: Jul. 21, 1987

[54] STOCKER IN REEL SUPPLY APPARATUS

[75] Inventors: Hideki Kobayashi, Tokyo; Yutaka Okumoto, Musashino; Mikio Komori, Matsudo, all of Japan

[73] Assignee: Japan Tobacco Company, Tokyo, Japan

[21] Appl. No.: 701,357

[22] Filed: Feb. 13, 1985

[30] Foreign Application Priority Data

Feb. 15, 1984 [JP] Japan ..... 59-025154

[51] Int. Cl.[4] ..... B65H 19/30

[52] U.S. Cl. ..... 414/744 R; 414/749; 414/910

[58] Field of Search ..... 414/222, 223, 744 R, 414/749, 750, 908, 910; 901/13, 19, 26; 242/58.6, 79

[56] References Cited

U.S. PATENT DOCUMENTS 3,119,009 1/1964 Zeller ..... 901/13 X
3,478,974 11/1969 Roscoe et al. ..... 242/58.6
3,999,665 12/1976 Rogers ..... 414/744 R
4,441,662 4/1984 Seragnoli ..... 242/58.6 X

FOREIGN PATENT DOCUMENTS 1786217 1/1972 Fed. Rep. of Germany .
2066789 7/1981 United Kingdom .
2091223 7/1982 United Kingdom .
2093439 9/1982 United Kingdom .

*Primary Examiner*—Robert J. Spar
*Assistant Examiner*—David A. Bucci
*Attorney, Agent, or Firm*—Murray and Whisenhunt

[57] ABSTRACT

A stocker in a reel supply apparatus can support and deliver various kinds of reels having different outer peripheral diameters. It has a housing mounted on a reversely revolvable cylindrical body. At the both sides of the housing, reel supporting frames are provided in such a manner as to extend toward the opposite directions. Within the reel supporting frame structures, revolvable threaded shafts are disposed. Pushers are engaged with the revolvable threaded shafts in order to move along the supporting frame structures, respectively.

3 Claims, 8 Drawing Figures

STOCKER IN REEL SUPPLY APPARATUS

BACKGROUND OF THE INVENTION

The present invention relates to a stocker in a reel supply apparatus for a main operation machine as in the case where, for example, tobacco roll paper reels are required to be sequentially supplied to a cigarette rolling machine as the paper is used.

In order to supply this kind of reels automatically, it is a usual practice to provide an automatic control travelling carrier along with a main operation machine, and the reels are delivered to the main operation machine through said travelling carrier. At this time, a stocker is required in order to deliver the supporting reels to the main operation machine in consecutive manner.

A conventional apparatus for supporting and delivering this kind of reels is disclosed in Japanese Patent Application Laid-Open to Public (Kokai Koho) No. Sho 57(1982)-156945. However, in this prior art, since reels are supported on three conveyor belts by facing the outer peripheral portions thereof in the axial direction and delivered by means of cooperation of the respective reels, there are such disadvantages as that reels having different outer diameters cannot be supported and handling is troublesome since the reels are readily damaged at the outer peripheral portions during delivery.

The present invention is accomplished in view of the above.

SUMMARY OF THE INVENTION

It is therefore an object of the present invention to provide a stocker in a reel supply apparatus which can support and deliver reels having different outer diameters.

Another object of the invention is to provide a stocker in a reel supply apparatus which can support and supply reels in consecutive manner without damaging the outer peripheral portions thereof.

A further object of the present invention is to provide a stocker in a reel supply apparatus which can supply reels on the one hand and load new reels on the other hand simultaneously.

In order to obtain the above objects, there is essentially provided a stocker in a reel supply apparatus for detaching an empty reel from a first bobbin of a cigarette rolling machine to discord the same, taking up a loaded reel from a stocker; attaching the loaded reel to said first bobbin, detaching another empty reel from a second bobbin of the cigarette rolling machine to discord the same, taking up another loaded reel from the stocker, and attaching said another loaded reel to said second bobbin, each reel having a core cylinder to be wound with paper therearound, reel attaching and detaching device comprising a stationary base positioned along said track; a housing rotatably mounted on said stationary base; at least one reel support arm having a size to allow insertion thereof into said core cylinder for receiving the reel thereon and attached to said housing to extend horizontally; and pusher means provided on said at least one reel support arm and adapted for movement to and fro therealong to push reels longitudinally outwardly and retreat longitudinally inwardly for receiving further reels.

DETAILED DESCRIPTION OF THE EMBODIMENTS

Figure 1:
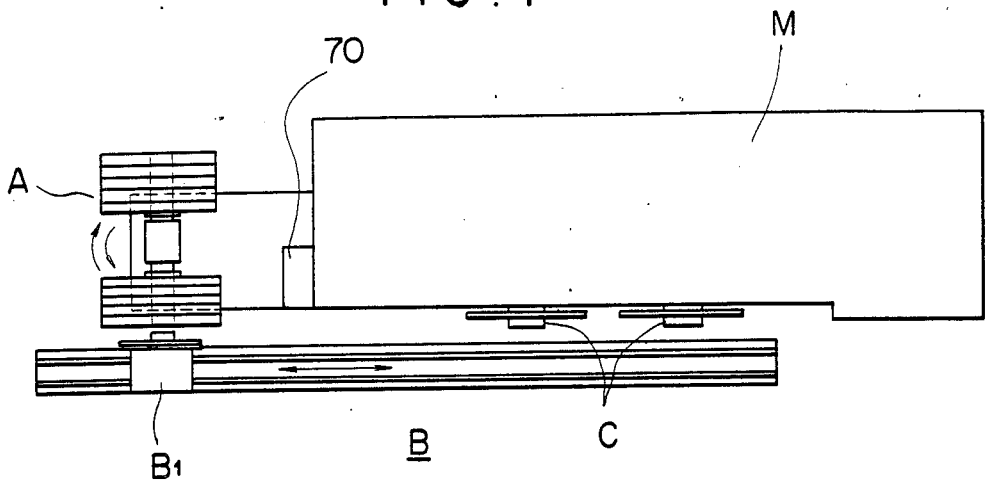
FIG. 1 is a plan view of schematically showing a device for supplying rice paper to a cigarette rolling machine.
Figure 7:
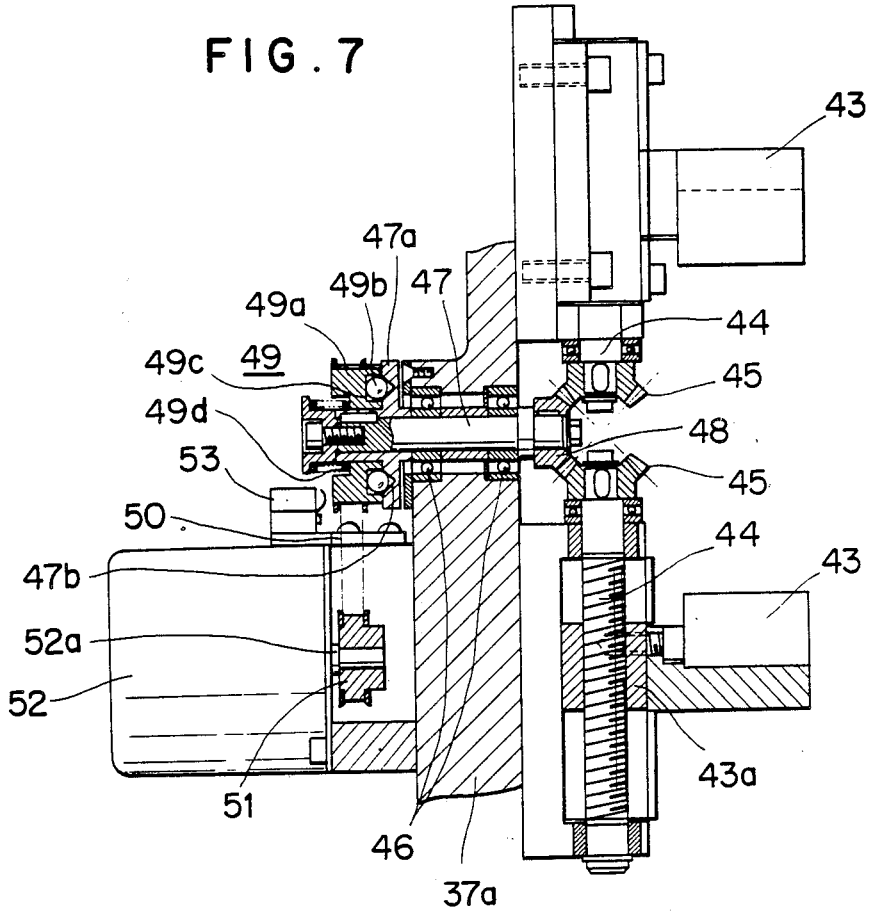
FIG. 7 is a detailed view of a mechanism for actuating the clamps on the travelling carrier.
Figure 2:
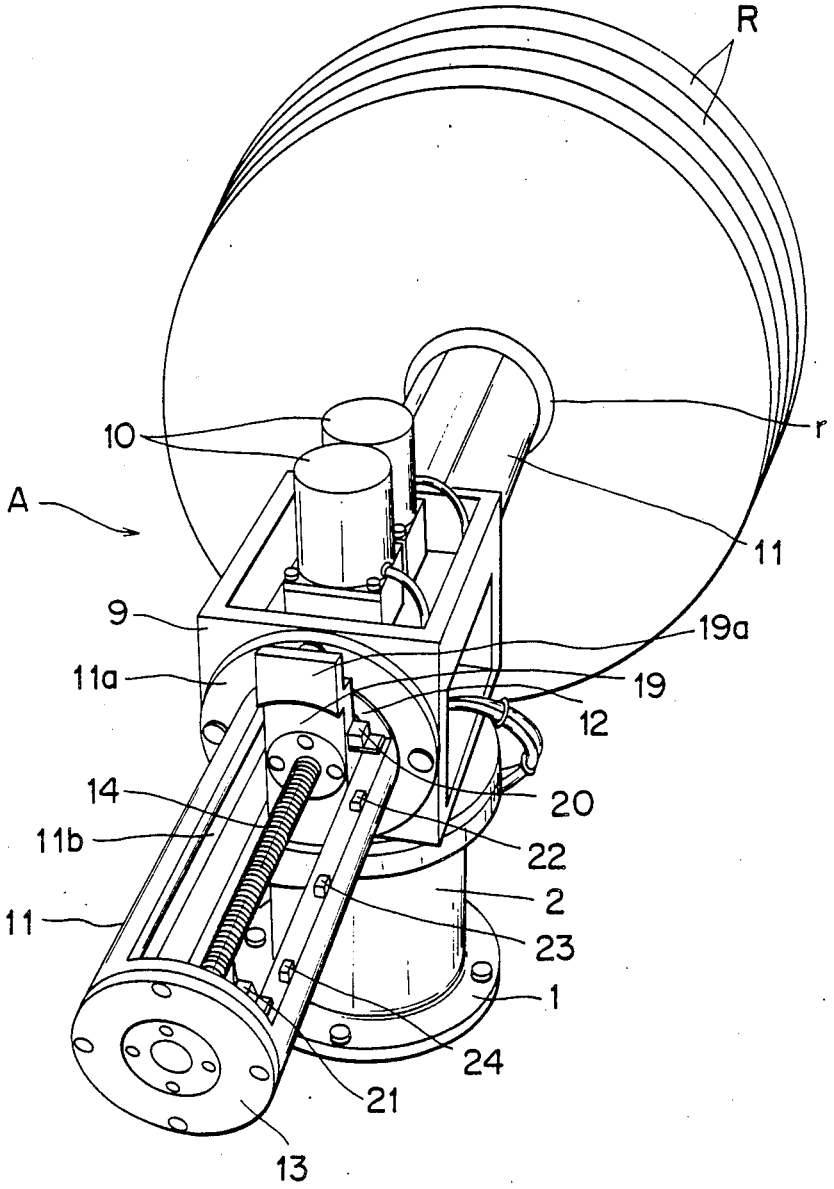
FIG. 2 is a perspective view of a stocker.
Figure 3:
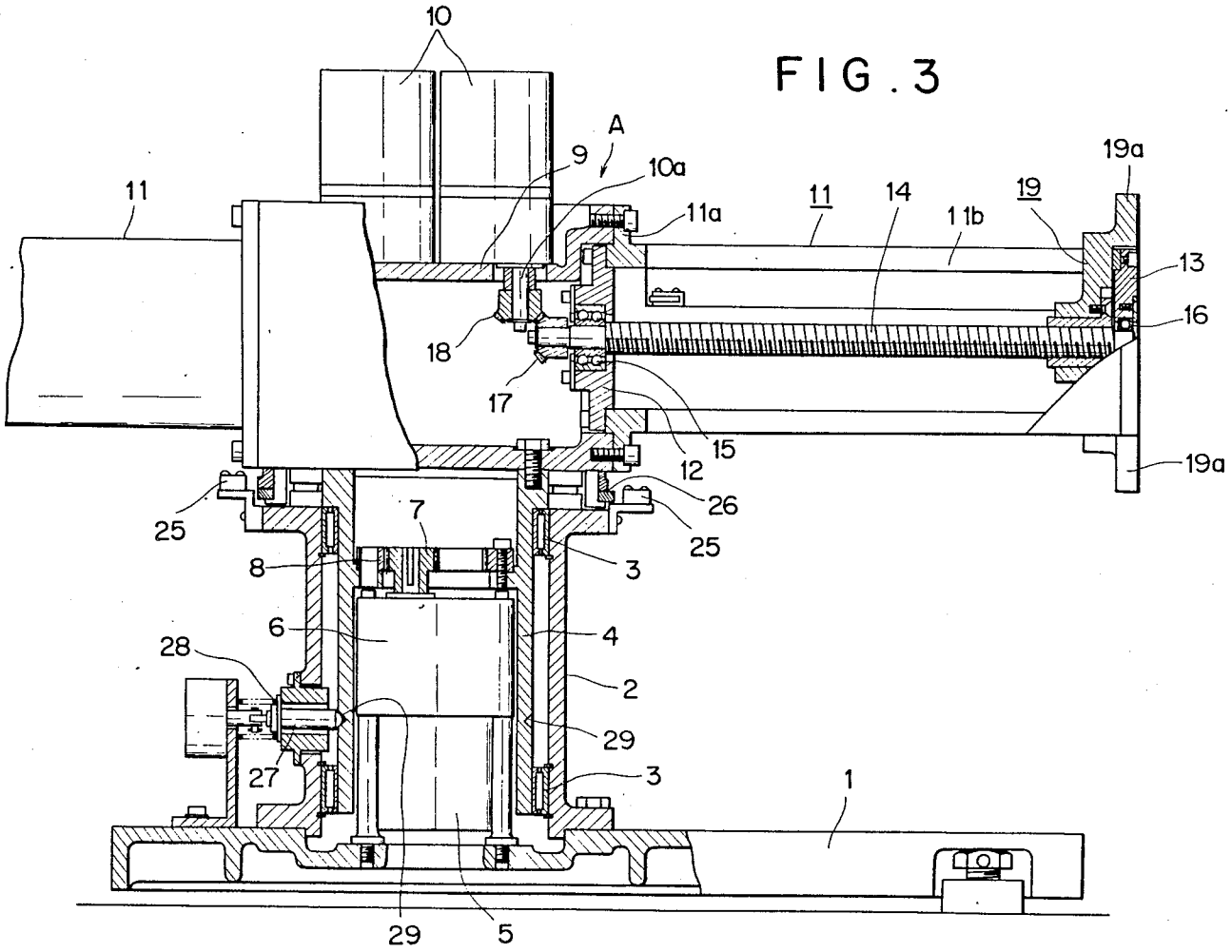
FIG. 3 is a side view, partly exploded of the stocker.
Figure 4:
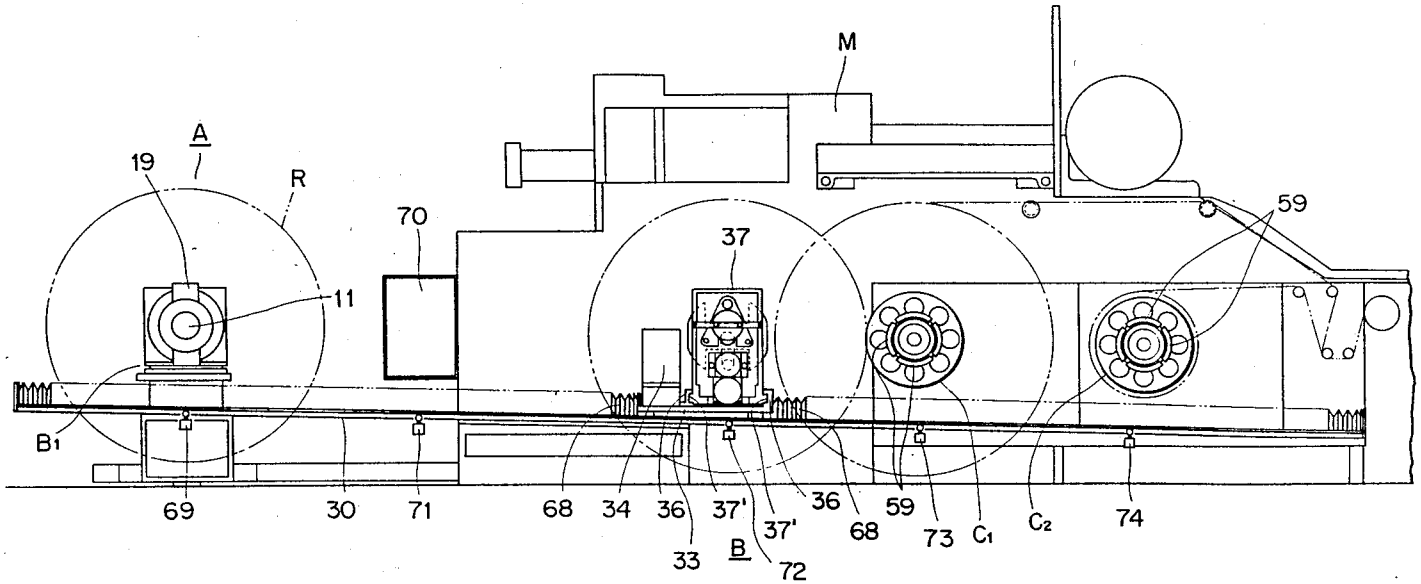
FIG. 4 is a front view of a carrier section.
Figure 5:
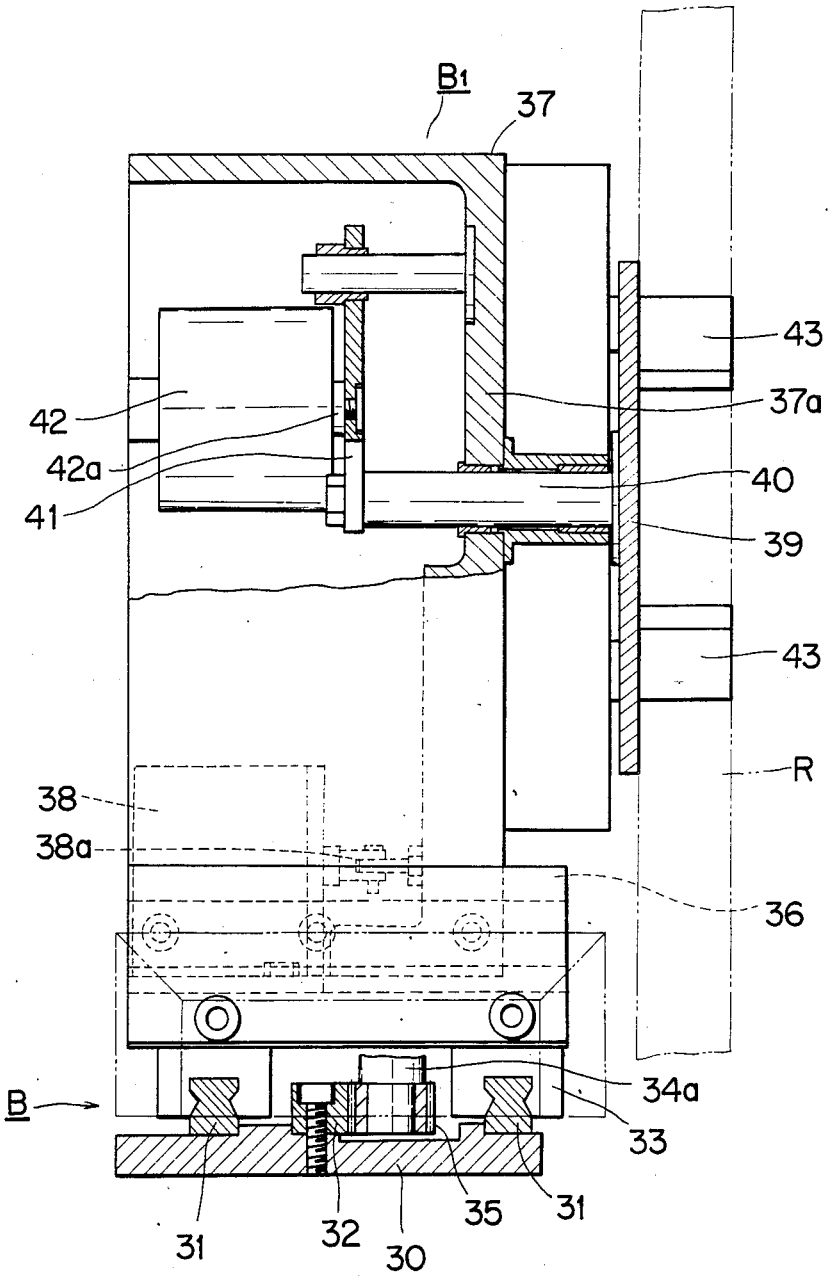
FIG. 5 is a side view, partly exploded, of a travelling carrier.
Figure 6:
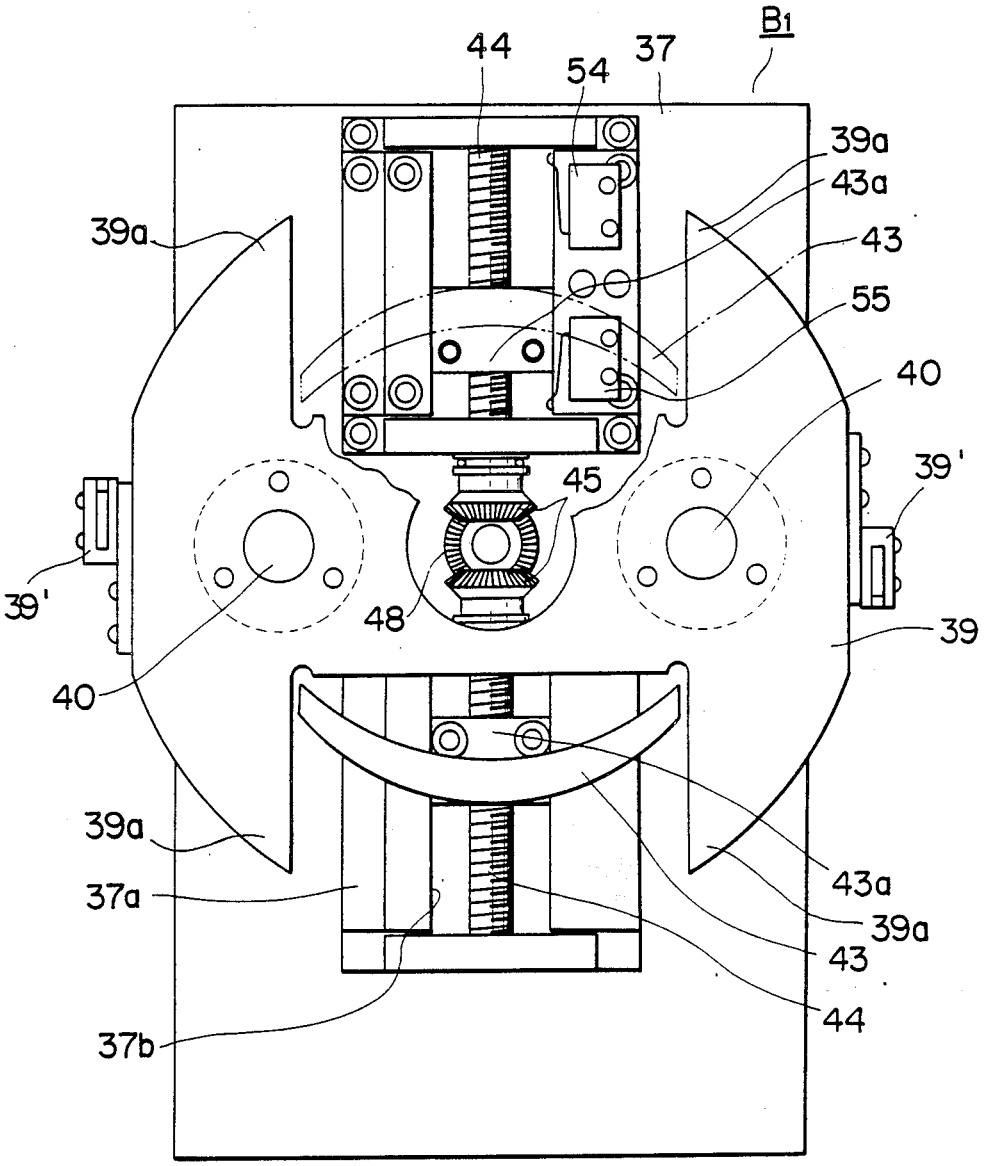
FIG. 6 is a front view of the travelling carrier.
Figure 8:
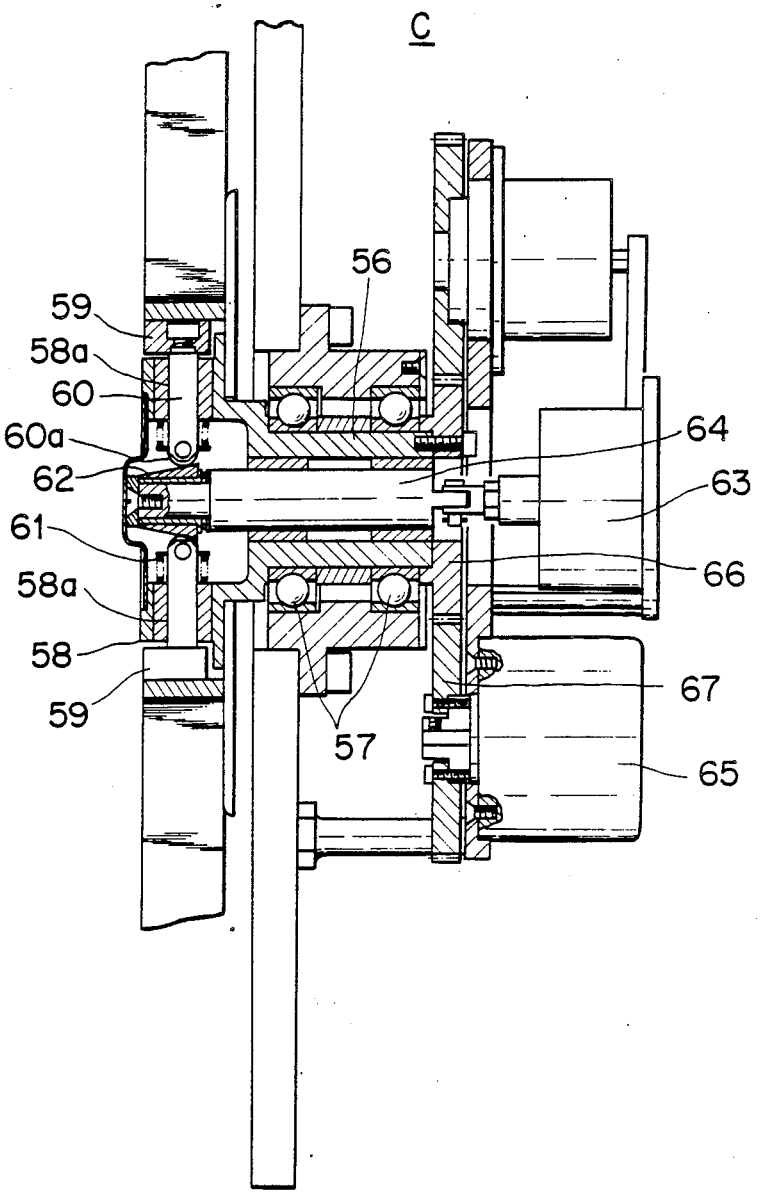
FIG. 8 is a sectional view of a bobbin section.

One preferred embodiment of the present invention will be described hereunder with regard to a device which automatically supplies reels with rice paper (cigarette rolling paper) to a cigarette rolling machine.

The automatic supply device according to the present invention comprises a stocker section A positioned at one side of a cigarette rolling machine M, a carrier section B adapted to receive a reel or reels from said stocker section and carry the same over to said cigarette rolling machine, and a bobbin section C adapted to receive the reel or reels from the carrier section B at the cigarette rolling machine M. Each roll R has a core cylinder r to be wound with paper therearound.

After the stocker section A is loaded at a reel support arm with a plurality of new reels wound with rice paper, it is caused to rotate reversely for intermittently delivering the reels to a waiting travelling carrier B1.

1 denotes a stationary base of the stocker section A positioned along a track which will be described later. A supporting cylindrical column 2 is erected upright on said base 1. Within said supporting cylindrical column 2, a revolvable cylindrical body 4 is positioned through a bearing 3. Within said revolvable cylindrical body 4, a motor 5 for reverse rotation and a reduction gear head 6 are mounted on said base 1, and a driving gear 7 thereof meshes with an internal gear 8 firmly secured within said revolvable cylindrical body 4.

At the upper end of said revolvable cylindrical body 4, a housing 9 is firmly secured. Two motors 10, 10 for pushers are mounted on the upper portion of the housing 9. At the right and left sides of the latter, support arms in the form of frame structures 11, 11 are firmly secured in symmetric relation with each other through flanges 11*a*, 11*a* thereof. Each frame structure 11 has a size to allow insertion thereof into said core cylinder r. Shaft supporting plates 12 and 13 are firmly secured to both end portions of said frame structure. A revolvable threaded shaft 14 is disposed intermediate said shaft supporting plates 12 and 13 through bearings 15 and 16. A bevel gear 17 is provided at the internal end of said revolvable threaded shaft 14 and meshed with a bevel gear 18 on a main driving shaft 10*a* of the motor 10 for the pusher.

At the upper and lower portions of said reel supporting frame 11, longitudinally extending guide openings 11*b* are formed, and a pressure end 19*a* of a pusher 19 screwed on the revolvable threaded shaft 14 extends out of said frame structure 11 through said guide openings 11*b*.

Said frame structure 11 is provided at its internal and external ends with limit switches 20 and 21 for sensing the retreating and progressing ends of the pusher 19 respectively. And three pieces of reel sensing limit switches 22, 23 and 24 adapted to sense the number of supporting reels are provided therebetween.

In opposite positions at the upper end of said supporting cylindrical column 2, reverse rotation stopping microswitches 25, 25 are mounted and on the lower end of the housing 9, a sensing cam 26 is mounted opposite thereto.

In order to establish an appropriate reverse rotation position, a retaining pin 27 is provided at the supporting cylindrical column 2 in a position in agreement with either one of said reverse rotation stopping microswitches 25 in the axial direction and in such a manner as to be biased toward the revolvable cylindrical body 4 by means of a coil spring 28. In opposite positions of the outer periphery of said revolvable cylindrical body 4, there are formed retaining holes 29, 29 for receiving said retaining pin 27 therein when the reverse rotation is to be stopped.

With the above constitution, in the state where the pusher 19 is retreated to the innermost end, a predetermined number of reels R with rice paper are engaged to one of the frame structures 11 having a size to allow introduction thereof into the core cylinder r, and said frame structure 11 is rotated for 180° by the reverse rotation motor 5, so that the frame structure 11 will extend perpendicularly toward the track of carrier section B. With the foregoing state, one of the motors 10 for the pusher 19 is driven to intermittently revolve the revolvable threaded shaft 14 for a predetermined amount and at the same time the pusher 19 is caused to move along the guide openings 11*b* longitudinally outwardly stepwise by a reel thickness distance. Then, the reels R with rice paper are pushed out to the travelling carrier B1 in consecutive manner. The motor 10 stops rotation according to a receiving signal from a sensor 39' mounted on the travelling carrier B1 for stopping the reel taking up operation.

In the meantime, said reels R with rice paper are manually loaded on the frame structure 11 at the opposite side manually and caused to rotate 180 degrees reversely as in the same manner as described in the above.

In the carrier portion B, a track including two rails 31, 31 are laid on a base 30, said rails 31, 31 extending from the stocker section A to the bobbin section C of the rolling machine. A rack 32 is fixed intermediate said rails 31, 31. A base plate 33 of the travelling carrier B1 is engaged to said rails 31, 31. A pinion 35 mounted on a main driving shaft 34*a* of a travelling motor positioned on said base plate 33 is meshed with said rack 32. The travelling carrier B1 is moved along said rails 31, 31 in accordance with the motion of said motor.

Another pair of guide rails 36, 36 are firmly secured on said base plate 33 of the travelling carrier B1, said guide rails 36, 36 extending in the transversing direction with respect to the travelling direction of said travelling carrier B1. A box 37 formed on the lower side thereof with a projection 37' is movably located intermediate the rails 36, 36 with said projection 37' engaged thereto. An air cylinder 38 is firmly secured to the base plate 33 and its piston 38*a* is connected to said box 37. According to the motion of said air cylinder 38, the box 37 is moved in the transversing direction with respect to the moving direction of the travelling carrier B1.

At the front of said box 37 with respect to the moving direction thereof, a pusher 39 is provided in order to assist to receive the reels R with rice paper, said pusher 39 also serving as a back plate thereof.

The pusher 39 is firmly secured to the external end of a slide shaft 40 movably supported by a partition wall 37*a* of the box 37. A piston 42*a* of an air cylinder 42 is connected to the internal end of said slide shaft 40 through a connection plate 41. As a result, the pusher 39 is caused to progress or retreat by said air cylinder 42. The pusher 39 is cut in a generally H shape so that cutting portions 39*a*, 39*a* at its upper and lower portions may receive therein clamps 43, 43 in such a manner as to allow them to move freely.

The clamps 43, 43 are each formed in a shape of arcuate plate body curving outward so that it will be in accord with the arcuate frame shape of the core of said reel R. The mounting base portions 43*a*, 43*a* of said clamps 43, 43 are engaged in a guide groove 37*b* extending in the vertical direction at the front of the partition wall 37*a* of said box 37. Said mounting base portions 43*a*, 43*a* are designed to be movable along said guide groove 37*b* in the vertical direction and threadedly engaged with revolvable threaded shafts 44, 44 extending in the vertical direction within said guide groove 37*b*.

Bevel gears 45, 45 are firmly secured to the opposite ends of said revolvable threaded shafts 44, 44 respectively and meshed with a bevel gear 48 mounted on one end of a driving shaft 47 carried by a bearing 46 at the partition wall 37*a*.

At the other end of said driving shaft 47 provided is a clutch mechanism 49 which is driven by a driving shaft 52*a* of a motor 52 through a gear belt pulley 49*a*, a gear belt 50 and a gear belt pulley 51 thereof. The gear belt pulley 49*a* is rotatably mounted on the driving shaft 47 and a ball 49*b* for engaging in a recess 47*b* formed in a flange 47*a* fixed to the driving shaft 47 is held in a chamber 49*c* opposite thereto. Since said gear belt pulley 49*a* is normally urged toward the flange 47*a* by a spring 49*d*, the gear belt pulley 49*a* and the driving shaft 47 are integrally rotated through said ball 49*b*. When the clamps 43, 43 are brought to be a predetermined clamping state, the driving shaft 47 becomes unrotatable. As a result, the gear belt pulley 49*a* departs from the flange 47*a* by resisting the force of the spring 49*d* and rotates idly. At this time, a limit switch 53 is actuated by said gear belt pulley 49*a* for stopping the motion of the motor 52.

At the side of the guide groove 37*b* formed in the partition wall 37*a*, a limit switch 54 for setting a waiting position for clamping an empty core from outside with said clamps 43, 43 is provided in the external position or upper position, while another limit switch 55 for setting a waiting position for clamping the reel R with rice paper from inside with the clamps 43, 43 is provided in the internal position or lower position.

At the front of the tobacco rolling machine, the bobbin section C is rotatably carried by a bearing 57 through a shaft portion 56. On the outer periphery of a supporting portion 58, four pieces of arcuate grippers 59 are firmly secured to the external end of a supporting bar 60 slidably disposed in a hole 58*a* extending in the radial direction of said supporting portion 58 so that said grippers 59 can move in the radial direction. The internal end 60*a* of the supporting bar 60 is abutted against a cam 62 biased by a spring 61. The cam 62 is connectd to a slide shaft 64 actuated by an air cylinder 63, and the four pieces of grippers 59 which are normally in pulled-in positions pulled by the spring 61 are pushed out by the air cylinder 63 at the time when said grippers 59 received the rice paper at the supporting portion 58, and the core cylinder r of the reel R is clamped from inside.

65 denotes a rotary encoder which associates with the rotation of the bobbin section C through gears 66 and 67. Said rotary encoder 65 transmits a signal according to the number of rotation so that said bobbin section C starts motion for receiving the reel R with rice paper from the travelling carrier B1.

The rails 31, 31 of said carrier portion B1 are provided at the both ends thereof with accordion-shaped covers 68, 68 connected to the both sides of the travelling carrier B1 respectively. When travelling, the travelling carrier B1 expands one of the covers 68 and contracts the other.

A plurality of limit switches for instructing stopping positions of the travelling carrier B1 are provided on said base 30. That is, there are provided a sensor 69 positioned opposite the stocker section A for receiving the rice paper, a sensor 71 for sensing a position for detaching an empty core corresponding to an empty core box 70, a sensor 72 for sensing an intermediate waiting position 72, a sensor 73 corresponding to a first bobbin C1, and a sensor 74 corresponding to a second bobbin C2 all arranged in this order from one end of the base 30 to the other.

With the above constitution, in the state that the first and second bobbins C1 and C2 are loaded with the reels R with rice paper, the clamps 43, 43 are moved outward when the travelling carrier B1 is at the intermediate waiting position. Firstly, when the rice paper of the first bobbin C1 is used up, the clamps 43, 43 are moved to the position where the first bobbin is located according to the signal from the rotary encoder 65. After the clamps 43, 43 are positioned outside of an empty core by the box 37 progressed by the air cylinder 38, they are moved inside by the motor 52. Upon clamping the empty core cylinder r with said clamps 43, 43, the box 37 is caused to retreat. Then, the travelling carrier B1 is travelled to the empty core box 70 for moving the box 37 in the same manner as mentioned before. After the empty core cylinder r is released from clamping by the clamps 43, 43, the pusher 39 is progressed by the air cylinder 42 for discharging the empty core cylinder r into the box 70. Thereafter, the travelling carrier B1 travels to the position of the stocker section A. At this time, the clamps 43, 43 are moved in the inside position. In this state, the pusher 39 which also serves as a back plate receives the rice paper reel R pushed from the stocker section A. At the same time, the clamps 43, 43 are moved to clamp the core section r from inside. Then, the travelling carrier B1 travels to a position corresponding to the first bobbin C1. After the box 37 is progressed, the pusher 39 is also progressed to push the reel R to the supporting portion of the first bobbin C1 for delivery and the gripper 59 is moved for securing the reel R by the cam 62 according to the operation of the air cylinder 63. Then, in the same state as mentioned before, the travelling carrier B1 stops in the intermediate waiting position and waits for an empty core cylinder of the second bobbin C2.

As described in the foregoing, since the present invention comprises a reversely revolvable cylindrical body, a housing mounted on said cylindrical body, a reel supporting frame structure extending toward the opposite directions from both sides of said housing, a motor provided at the housing, a revolvable threaded shaft disposed within said supporting frame structure and driven by said motor, and a pusher threadedly engaged with said revolvable threaded shaft and movable along said supporting frame structure, various kinds of reels having different outer diameters can be supported for delivery. Also, since the inverted apparatus adopt a central portion supporting method, reels will not be damaged when delivered. Furthermore, since the supporting frame structure and/or pushers are arranged in a right and left symmetric relation, while reels are being delivered at one side, new reels can be loaded at the other side, and the newly loaded reels side can be promptly reversely revolved in order to meet with further requirement.

What is claimed is:

1. A stocker in a reel supply apparatus for delivering a loaded reel having an open core cylinder of a predetermined diameter onto a movable carrier running on a track, said stocker comprising:

a stationary base positioned along said track;

a motor fixedly mounted on said stationary base;

a revolvable cylindrical body having a vertical axis, said cylindrical body revolvable about said vertical axis, said cylindrical body having a first stop position and a second stop position, said first stop position and said second stop position being angularly displaced from one another by 180 degrees;

support means, fixedly mounted to said stationary base, for supporting said cylindrical body for rotation about said vertical axis;

gear transmission means, operably connected to said motor and to said cylindrical body, for revolving said cylindrical body about said vertical axis in response to operation of said motor;

sensor means for detecting said first stop position and said second step position;

locking means for locking said cylindrical body at said first and second stop positions, said locking means operable in response to sensing of said first and second stop position by said sensor means;

a gear box mounted on top of said cylindrical body;

a pair of reel support arms fixedly attached to said gear box to extend horizontally on opposite sides thereof, said support arms having a diameter substantially corresponding to the predetermined diameter of the open core cylinder of the reel to allow the insertion thereof into said core cylinder for snugly, slidingly receiving the reel thereon and holding the reel thereon at a right angle thereto, said pair of reel support arms extending perpendicular to said track at said first stop position and said second stop position, each reel support arm comprising a pair of elongated arc sections, said pair of elongated arc sections defining a pair of diametrically opposed gaps therebetween, each reel support arm having an inner end adjacent said gear box and an outer end remote from said gear box, each reel support arm having a pair of shaft supporting plates, each shaft supporting plate mounted at a respective end of said reel support arm;

pusher means, disposed on said reel support arms, for movement therealong to push the reels outwardly stepwise one-by-one, said pusher means comprising a rotatable threaded shaft journaled in each pair of said shaft supporting plates and a pusher member threadingly engaging said rotatable threaded shaft and extending through said gaps of said reel support arm at right angles with said reel support arms; and a drive motor, provided at said inner end of said rotatable threaded shaft, for rotating said threaded shaft by a predetermined amount to push each reel outward in a stepwise manner by a distance corresponding to a reel thickness, whereby said reels are moved along said reel support arms while maintaining a right angle with said reel support arm.

2. A stocker according to claim 1, wherein said gear box contains a pair of bevel gears intermeshed with each other and respectively attached to said rotatable threaded shaft and said motor.

3. A stocker according to claim 1, wherein said support means comprises a hollow cylindrical column fixedly mounted to said stationary base to surround said cylindrical body.

* * * * *

UNITED STATES PATENT AND TRADEMARK OFFICE

CERTIFICATE OF CORRECTION

PATENT NO. : 4,681,505

DATED : July 21, 1987

INVENTOR(S) : Hideki Kobayashi, Yutaka Okumoto, Mikio Komori

It is certified that error appears in the above-identified patent and that said Letters Patent is hereby corrected as shown below:

In the heading of the patent, in the line labelled "[73] Assignee:", delete "Japan Tobacco Company" and insert --Japan Tobacco Inc.--

Signed and Sealed this

Twelfth Day of January, 1988

*Attest:*

*Attesting Officer*

DONALD J. QUIGG

*Commissioner of Patents and Trademarks*